United States Patent [19]

Modlin

[11] Patent Number: 4,871,280

[45] Date of Patent: Oct. 3, 1989

[54] RETRACTABLE PAVEMENT MARKER/REFLECTOR

[76] Inventor: Delbert J. Modlin, 130 Moss Rock Ct., Folsom, Calif. 95630

[21] Appl. No.: 23,139

[22] Filed: Mar. 9, 1987

[51] Int. Cl.[4] ..... E01F 9/04

[52] U.S. Cl. ..... 404/10; 404/11

[58] Field of Search ..... 404/9, 10, 11, 14, 16

[56] References Cited

U.S. PATENT DOCUMENTS

| | | | |
|---|---|---|---|
| 1,797,498 | 3/1931 | Finley | 404/11 |
| 1,802,940 | 4/1931 | Cornelius | 404/10 |
| 3,216,335 | 11/1965 | Stolarczyk et al. | 404/11 |
| 3,880,537 | 4/1975 | Harris et al. | 404/10 X |
| 4,297,051 | 10/1981 | Robinson | 404/11 |
| 4,597,691 | 7/1986 | Clarke | 404/11 |

*Primary Examiner*—Bruce M. Kisliuk
*Assistant Examiner*—Matthew Smith
*Attorney, Agent, or Firm*—Jonn E. Halamka

[57] ABSTRACT

A plastic retractable pavement marker/reflector having a base with a freely rotatable depressable cap projecting upwardly therefrom. A neoprene material or some other non-absorbent flexible material is used to fill the cavity inside the base, thereby keeping out debris and other substances to make sure the cap remains depressable. After being compressed by the depressable cap, the neoprene material expands back to its original size, thereby forcing the cap to return to its original position projecting upwardly from the base, again making the cap visible from all directions.

6 Claims, 1 Drawing Sheet

RETRACTABLE PAVEMENT MARKER/REFLECTOR

BACKGROUND OF INVENTION

The problem of inadequate markings on streets and highways in snow areas has existed for a long time.

Pavement markers extending above roadway surfaces have exhibited tendencies to be easily dislodged by passing snowplows. Markers recessed in the roadways have also proven to be unsatisfactory because of their reduced visibility. Other pavement markers have been too costly to manufacture or install because of their complex structure.

The principal object of this invention is to provide a durable, low cost retractable pavement marker/reflector that will not interfere with the plowing of snow and is easy to install.

SUMMARY OF INVENTION

This retractable pavement marker/reflector is positioned just below road level. Inside the base is a depressable plastic cap that extends above the roadway to insure better visibility from all directions. The cap is usually colored white or yellow and may be reflectorized by using an illuminating substance such as paint or glass spheres. Other reflectorizing substances may also be used.

When a vehicle or snowplow makes contact the cap is depressed into the base, thereby compressing an enclosed, nonabsorbant, flexible, neoprene material. When the vehicle or snowplow passes, the neoprene material expands back to its original size, thereby forcing the cap to return to its original position.

The nonabsorbant neoprene material prevents water, ice, and other substances from forming or settling inside the base, thereby insuring that the cap remains depressable in all types of weather.

This invention is inexpensive to manufacture because of its simple structure. It is also easy to install.

DETAILED DESCRIPTION OF THE DRAWINGS

Figure 1:
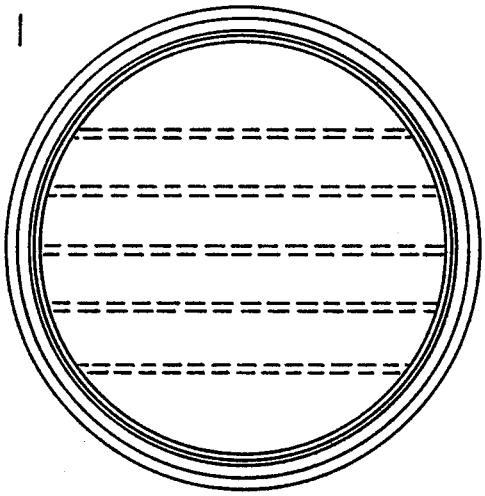
FIG. 1 is a top plan view of a retractable pavement marker/reflector constructed in accordance with the present invention.
Figure 2:
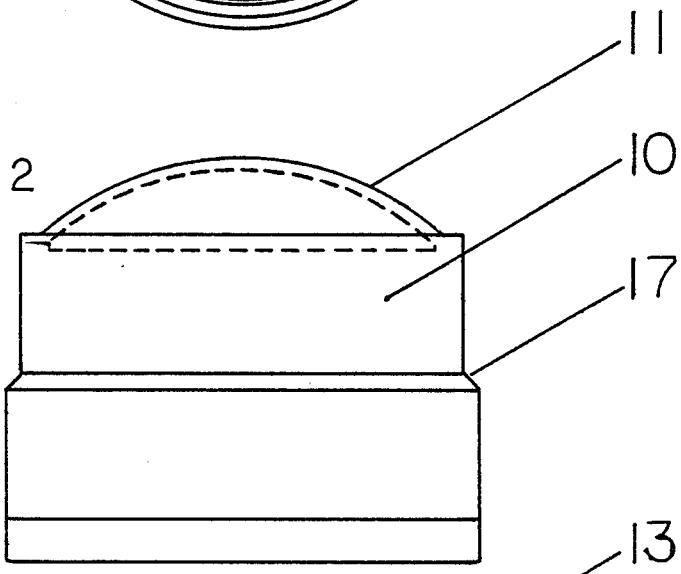
FIG. 2 is a side view of a retractable pavement marker/reflector including a side plan view of the support grids in the cap.
Figure 3:
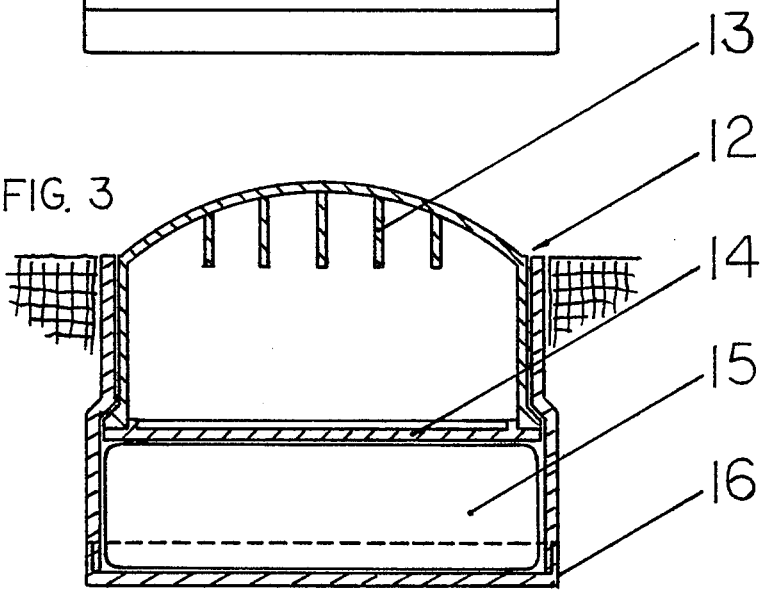
FIG. 3 is a cut-away side view of a retractable pavement marker/reflector constructed in accordance with the present invention.

The base 10, cap 11, plate 14 and bottom 16 of the retractable pavement marker/reflector, illustrated in FIG. 1–3, are formed by injection molding using a rigid PVC plastic material. Other plastic materials may also be used. The plastic material is usually colored white or yellow to coincide with the color of lines on the roadways.

The retractable pavement marker/reflector is installed by placing it into a small hole drilled into the surface of the roadway. The top of the base 10 is placed just below or even with the road surface. The top portion of the cap 11 extends above the road surface and is visible from any direction. A fast-setting adhesive such as epoxy glue is placed around the base 10 to permanently affix the retractable pavement marker/reflector in the roadway.

The base 10 is cylinder shaped and hollow. The bottom portion of the base 10 is larger than the top portion. The reduced diameter near the middle of the base 10 functions as a stop 17 to insure that the cap 11 remains inside the base 10.

The depressable cap 11 has the freedom to rotate inside the base 10 and the top portion of the cap 11 extends above the roadway making it more visible from all directions. The cap 11 may be plain or it may be reflectorized. Glass spheres imbedded in the plastic, reflectorized paints or other substances may be used to reflectorize the cap 11. The support grids 13 underneath the the dome make the cap 11 more durable.

Additional support is provided by the plate 14 which is attached to the bottom of the cap 11 with an adhesive. The plate 14 also helps equalize the pressure exerted against the neoprene material 15 when the cap 11 is depressed into the base 10.

The neoprene material 15 is flexible and practically nonabsorbant. It completely fills in the cavity inside the base 10, between the plate 14 and the bottom 16. It prevents water, ice, and other substances from forming or settling inside the base 10, thereby insuring that the cap 11 will remain depressable in all types of weather. Other flexible nonabsorbant materials may be used.

When a vehicle or snowplow comes in contact with the cap 11, the cap 11 depresses into the base 10, thereby compressing the neoprene material 15. As the cap 11 depresses into the base 10, compressed air escapes through the narrow clearance between the cap 11 side wall and the base 10 side wall. Any debris or dust that may have settled within the clearance will thereby be forced out by the compressed air.

After the vehicle or snowplow passes, the neoprene material 15 expands back to its normal size, thereby forcing the cap 11 back to its original position. As the cap 11 returns to its original position, the ridge 12 on the top edge of the cap 11 assists in keeping debris and other substances from becoming wedged between the cap 11 side wall and the base 10 side wall.

The bottom 16 is attached to the base 10 with an adhesive, therby insuring that the neoprene material 15, plate 14 and cap 11 remain inside the base 10.

Having thus described the invention, I claim:

1. A retractable pavement marker/reflector comprising, in combination:

- a base with a depressible cap projecting upwardly therefrom, and said cap having complete freedom of rotation;
- said base includes;
  - a plurality of cylindrical walls having;
  - a first inside surface of a preselected first inside diameter and a preselected first length having a first end and a second end; and
  - at least a second inside surface of a second inside diameter preselected to be smaller than said first inside diameter and a preselected second length having a first end and a second end;
- a stop connecting said second end of said first inside surface and said first end of said second inside surface;
- a bottom having substantially a disk shape of a diameter equal to the outside diameter of said cylindrical wall having said first inside surface and connected to said first end of said cylindrical wall;

said depressible cap includes;

a top circular portion of a preselected diameter smaller than the inside diameter of said second inside surface of said base and having a convex upper surface;

cap cylindrical walls having, a first end and a second end, an outside diameter equal to the outside diameter of said top portion and connected by said first end to the periphery of said top portion by the surface opposite said convex upper surface, said walls having a preselected length approximately equal to the length of said of said second inside surface;

a circular plate, having a preselected diameter larger than the inside diameter of said second inside surface of said base and smaller than the inside diameter of said first inside surface of said base, connected to said second end of said cap cylindrical walls whereby the periphery of said circular plate extends beyond the outside cylindrical surface of said cap cylindrical walls;

whereby under the condition of said bottom detached from said cylindrical wall and said depressible cap axially insertable, top circular portion first, into said base through said first inside surface and then into said second inside surface, said top portion of said depressible cap extends above the second end of said second inside surface and said periphery of said circular plate is substantially adjacent to said stop.

2. A retractable pavement marker/reflector as set forth in claim 1 further comprising:

compressible, non-absorbant, flexible material with memory having a cylindrical shape of a preselected outside diameter smaller than said first inside surface, a first end and a second end, mounted inside said base below said circular plate and having a preselected length shorter than the length of said first inside surface whereby under the condition of said first end substantially adjacent to said circular plate, said second end is substantially adjacent to said first end of said first inside surface, thereby filling the cavity under said cap;

whereby under the condition of said top circular portion of said depressible cap being forced below said second end of said second inside surface, said material is compressed and said memory will push against said circular plate of said depressible cap until said top circular portion of said depressible cap is above said second end of said second inside surface.

3. A retractable pavement marker/reflector as set forth in claim 1 further comprising:

a plurality of support grids mounted on the side of said top circular portion which is connected to said cap cylindrical walls whereby said top circular portion is strengthened and displaces depressing force applied on said top portion through said cap cylindrical walls to said circular plate.

4. A retractable pavement marker/reflector as set forth in claim 1 further comprising:

a ridge around the periphery of said top circular portion on the side of said top circular portion opposite the side connected to said cap cylindrical walls.

5. A retractable pavement marker/reflector as set forth in claim 2 further comprising:

a plurality of support grids mounted on the side of said top circular portion which is connected to said cap cylindrical walls whereby said top circular portion is strengthened and displaces depressing force applied on said top portion through said cap cylindrical walls to said circular plate whereby said compressible, non-absorbant, flexible material with memory is depressed.

6. A retractable pavement marker/reflector as set forth in claim 2 further comprising:

a ridge around the periphery of said top circular portion on the side of said top circular portion opposite the side connected to said cap cylindrical walls.

* * * * *